US008813966B2

(12) United States Patent
Kuzmin et al.

(10) Patent No.: US 8,813,966 B2
(45) Date of Patent: Aug. 26, 2014

(54) PNEUMATIC VACUUM SEPARATION PLANT FOR BULK MATERIALS

(71) Applicants: Aleksandr Vladimirovich Kuzmin, Novokuznetzk (RU); Andrey Vladimirovich Kalina, Moscow (RU); Grigory Nikolaevich Tabakov, Moscow (RU); Dmitriy Yurievich Boyko, Novokuznetzk (RU); Vladimir Semenovich Polomarchuk, Novokuznetzk (RU)

(72) Inventors: Aleksandr Vladimirovich Kuzmin, Novokuznetzk (RU); Andrey Vladimirovich Kalina, Moscow (RU); Grigory Nikolaevich Tabakov, Moscow (RU); Dmitriy Yurievich Boyko, Novokuznetzk (RU); Vladimir Semenovich Polomarchuk, Novokuznetzk (RU)

(73) Assignee: Limited Liability Company "Promyshlennoe Obogaschenie", Moscow (RU)

( * ) Notice: Subject to any disclaimer, the term of this patent is extended or adjusted under 35 U.S.C. 154(b) by 35 days.

(21) Appl. No.: 13/621,939

(22) Filed: Sep. 18, 2012

(65) Prior Publication Data

US 2013/0015105 A1 Jan. 17, 2013

Related U.S. Application Data

(63) Continuation-in-part of application No. PCT/RU2010/000528, filed on Sep. 23, 2010.

(51) Int. Cl.

| | |
|---|---|
| ***B07C 5/00*** | (2006.01) |
| ***B03B 4/04*** | (2006.01) |
| ***B07B 4/08*** | (2006.01) |

(52) U.S. Cl.
CPC .... *B07B 4/08* (2013.01); *B03B 4/04* (2013.01)
USPC ..... 209/44.2; 209/466

(58) Field of Classification Search
USPC ..... 209/3, 44.2, 312, 318, 466, 494; 15/345, 346
See application file for complete search history.

(56) References Cited

U.S. PATENT DOCUMENTS 4,411,038 A * 10/1983 Mukai ..... 209/466
4,652,362 A 3/1987 Mueller

FOREIGN PATENT DOCUMENTS

| | | |
|---|---|---|
| RU | 2130817 | 5/1999 |
| RU | 2176566 | 10/2001 |
| RU | 78703 | 10/2003 |

OTHER PUBLICATIONS

Search report in PCT/RU2010/000528, dated Mar. 24, 2011.

* cited by examiner

*Primary Examiner* — Joseph C Rodriguez
*Assistant Examiner* — Kalyanavenkateshware Kumar
(74) *Attorney, Agent, or Firm* — Bardmesser Law Group

(57) ABSTRACT

A system for density-based particle separation includes a loading bin, a separating feeder, a mesh conveyor belt, a compressor for the mesh conveyor belt, transporting nozzles integrated with the separation bins and located over the mesh conveyor belt, discharge nozzles positioned under the mesh conveyor belt in the same plane with transporting nozzles and adjusted for separation of the primary material into particle products of specific density and an aspiration systems (cyclones), as well as fans for generation of ascending sucking air flows in the transporting nozzles and discharge flows in the discharge nozzles.

5 Claims, 1 Drawing Sheet

PNEUMATIC VACUUM SEPARATION PLANT FOR BULK MATERIALS

CROSS-REFERENCE TO RELATED APPLICATIONS

This application is a continuation in part of PCT/RU2010/000528, filed on Sep. 23, 2010, which is incorporated by reference herein in its entirety.

BACKGROUND OF THE INVENTION

1. Field of the Invention

The present invention is related to a system and method for separation of loose granular substrates, and more particularly, to pneumatic vacuum separation of loose materials.

2. Description of the Related Art

Separation of loose granular materials with different densities has been used in variety of industries, such as, coal or gold mining, construction, chemical production, food, agricultural processing and metal industries. It can be used for preliminary and final coal production, ferrous, non-ferrous and noble metals processing, metal slag separation, non-metallic materials separation, separation of food products, industrial and domestic wastes, etc.

A machine for separation of materials with different density is disclosed in French Patent Application No. 2326989, published on Oct. 6, 1975. This system has a separation chamber with an inlet feeder, a cascade of angled surfaces with slots between them, through which pressurized air is supplied from the bottom and sucked in together with small particles from the top of the separation chamber.

The disclosed system has several essential shortcomings. Direction of the separating air flow is from the bottom to the top. The air flow goes through an entire layer of the material, and separation effect requires intensive air flow with considerable pressure (more than 1500 kg/m). Mutual screening of particles does not allow for good efficiency of the process and separation of the material particles with a clear size definition. The system is designed mostly for dust removal.

Another conventional system is a pneumatic separation plant (Russian Patent No. 2282503, Aug. 27, 2006) consisting of a loading bin, a feeder, an air-permeable conveyor belt and nozzles located over the conveyor track and adjusted for separation of the primary material into particles of specific density. The system also includes separating chambers and a suction device for the nozzles. The system also has cyclones and a filter. The nozzles are located at different height from the conveyor belt. The suction device is implemented as a ventilation plant. The shortcoming of this system is inability to regulate technological parameters of separation process by regulating the parameters of suction devices.

Another solution (Russian Utility Model Patent RF No. 78703, 2006) is a pneumatic separation plant consisting of a loading bin, a feeder, an air-permeable conveyor belt, and nozzles located over the conveyor track. The nozzles are adjusted for separation of the primary material into particles of specific density. The system also includes separating chambers, duct collecting system, as well as, suction device for the nozzles. The feeder allows for uniform supply of the primary material to the conveyor belt.

All the nozzles are located at the same distance from the conveyor belt, which ensures free flow of the separated particles. The nozzles are located along the air-permeable conveyor belt at a distance that excludes influences of air flows on the separation process from the nearby nozzles. The nozzles can be moved in a vertical plane. A collector of every nozzle is dead-ended from one side and is connected to the separation chamber from the other side. The separating chamber is connected to the suction device through the dust collecting system.

The shortcoming of this plant is adhesion of fine dispersed particles to the sides of nozzles, horizontal pipes, and round separating chambers. This changes dimensions of the cross section and the basic technological parameters of separation, causing decreased efficiency and production losses. The structure of the plant does not allow for changing the height of the nozzle over the mesh. This makes the process of precise density separation impossible, because the nozzle edge is fixed over the mesh and the air flow affects different size particles unequally. The structure of the plant does not allow to separate plate-shape material, which affects the quality of the recovered product particles.

Accordingly, a particle separation system that improves the quality of separated product particles is desired. Such a system should increase the capacity of a single unit as well as the service and technological reliability.

SUMMARY OF THE INVENTION

The present invention is directed to a system and method for pneumatic vacuum separation of loose granular substrates that substantially obviates one or several of the disadvantages of the related art. In one aspect of the invention, a pneumatic vacuum system for separation of loose granular materials is provided.

The system consists of a loading bin, a separating feeder, a mesh conveyor belt, a compressed air blowing device for the mesh conveyor belt, transporting nozzles integrated with the separation bins and located over the mesh conveyor belt, discharge nozzles positioned under the mesh conveyor belt in the same plane with transporting nozzles and adjusted for separation of the primary material into particle products of specific density, an aspiration systems (cyclones), as well as, devices for generation of ascending sucking air flows in the transporting nozzles and discharge flows in the discharge nozzles.

Additional features and advantages of the invention will be set forth in the description that follows, and in part will be apparent from the description, or may be learned by practice of the invention. The advantages of the invention will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE ATTACHED FIGURES

The accompanying drawings, which are included to provide a further understanding of the invention and are incorporated in and constitute a part of this specification, illustrate embodiments of the invention and, together with the description, serve to explain the principles of the invention.

DETAILED DESCRIPTION OF THE PREFERRED EMBODIMENTS

Reference will now be made in detail to the preferred embodiments of the present invention, examples of which are illustrated in the accompanying drawings.

According to the exemplary embodiment, a method and system for pneumatic vacuum separation of loose granular substrates are provided. The system comprises: a loading bin, a separating feeder, a mesh conveyor belt, a compressed air blowing device for the mesh conveyor belt, transporting nozzles are integrated with the separation bins and located over the mesh conveyor belt, discharge nozzles positioned under the mesh conveyor belt in the same plane with transporting nozzles and adjusted for separation of the primary material into particle products of specific density. The system also comprises an aspiration systems (cyclones), as well as devices for generation of ascending suction air flows in the transporting nozzles and discharge flows in the discharge nozzles.

According to an exemplary embodiment, the separating feeder is implemented as a finned surface with slots (located lengthwise) for removal of the plate-shaped particles of the loose granular mixture and for ensuring uniform supply of the remaining material to the conveyor belt. The conveyor belt is cleaned by a compressed air blowing device. All the transporting nozzles are located at different distances from the mesh conveyor belt for enabling separation of the remaining particles of the granular mixture according to the target densities.

According to the exemplary embodiment, all the discharge nozzles are located under the transporting nozzles at different distances from the mesh conveyor belt. The transporting and the discharge nozzles can be moved vertically along the mesh conveyor belt. The discharge nozzles are connected directly to the generating the discharge air flow devices. These devices generate the discharge air flow of different velocity and power. The aspiration systems (i.e., cyclones) connect the transporting nozzles unified with the separating bins to the suction devices, that generate the specific velocity and lifting power of the air flow.

According to the exemplary embodiment, the separating feeder can contain a frame and a tray with adjustable angle of slope. According to another exemplary embodiment, the separating feeder can contain a frame, a tray mounted on a vibratory suspension and a vibrator in a form of an electrical motor with a misbalanced shaft.

The working member of the compressed air blowing device for the mesh conveyor belt can be implemented as a nozzle with a slot of the same width as the mesh conveyor positioned lengthwise.

Figure 1:
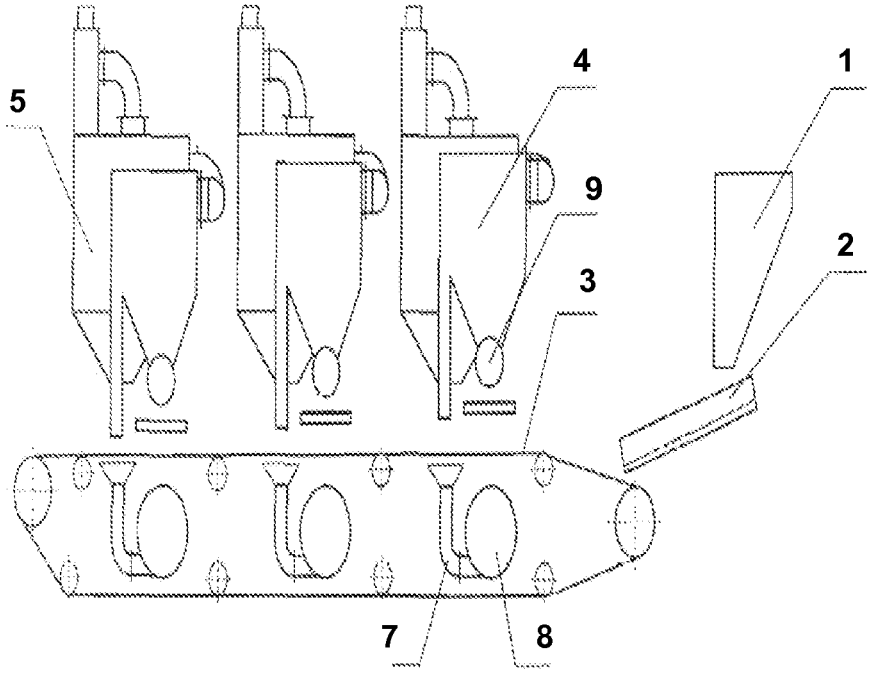
FIG. 1 illustrates a side view of the system, in accordance with the exemplary embodiment.

FIG. 1 illustrates a side view of the system, in accordance with the exemplary embodiment. The pneumatic vacuum separation system consists of a bin 1, a feeder 2 equipped with a separator, a mesh conveyer belt 3, transporting nozzles integrated with separating bins 4, cyclones 5, smoke exhausters 6, discharge nozzles 7, fans 8, unloading outlets 9, outlet conveyor 10. Separating bins are implemented as a device for speeding-up pressurized gas flow and directing it into the low pressure area.

The separating bins are made of a square branch pipe (or a rectangular shape pipe). One end of the pipe is connected to the suction container, and the other end of the pipe intakes the atmospheric air. After the primary material (pre-classified by size) is accumulated in the bin 1, the mixture is supplied to the feeder 2.

The working surface of the vibrating separating feeder consists of a set of plates. The special gaps between the plates ensure the removal of plate-shaped material and a uniform distribution of a round-shaped material along the height and width of the mesh conveyor belt 3. The openings size of the mesh conveyor belt 3 prevents spilling of the material and ensures the sufficient air permeability. While moving on the mesh conveyor belt 3, the material gets under the influence of the discharged air flow from the discharge nozzle 7.

The air flow affects the particles from below, through the mesh of the conveyor. The air flow orientates the particles without lifting them over the surface of the mesh conveyor and gives them the most favorable orientation for effective density separation with the center of gravity taking the lowermost point (that ensures the particle midsection stability). With the subsequent movement of the belt, the particles get under the influence of the ascending sucking flow, generated be transporting nozzles 4.

Figure 2:
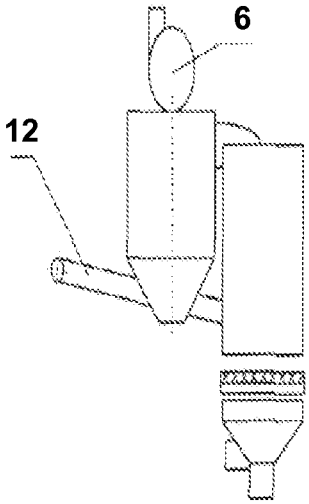
FIG. 2 illustrates a particle orientating unit, in accordance with the exemplary embodiment.

The ascending flow sucks the particles of smaller weight into the transporting nozzle 4. Then, after collision with the deflector inside the transporting nozzle (chamber) 4, the material gets over to unloading area and is dropped down to the outlet conveyor 10 by a drop-off outlet 9. FIG. 2 illustrates a particle orientating unit having the outlet conveyor 10 and the fan 8.

As shown in FIG. 2, the discharge and transporting nozzles are either of equal width, or the discharge nozzles are slightly wider; at the same time, a discharge nozzle is at least twice as thick as a transporting one. in the preferred embodiment, nozzle exits are rectilinear and parallel to the surface of the mesh, which is set to the horizontal level.

The dust produced by separation and collision is collected by cyclones 5. The material that remains on the mesh conveyor belt after passing the first zone of separation goes to the next zone adjusted to extract particles of different density. Alternatively, the remaining particles can be removed from the process.

According to the exemplary embodiment, each of the transporting nozzles can be adjusted for a specific density and separation efficiency by changing the distance between the surface of the mesh and the transporting nozzle inlet, by changing the height of the working area of the transporting nozzle, (the minimal distance is defined by the maximum size of the separated material particles), by changing operation mode of the smoke exhausting device, by restricting the air flow before and (or) after the smoke exhauster.

The number of separation zones is defined by the amount of the target product particles with different density. The number of recovered types of product particles is the number of separating zones plus one. The proposed system (plant) is simple to operate. The adjustments can be advantageously made without interrupting the process. The plant provides for high efficiency density-based separation of particles, including the products with small density difference. The system also ensures minimum mutual contamination of the separated products.

If the machine is loaded with uniform density products, they are separated by the size and the shape. The proposed system is valid for industrial use, in particular, in mining industry, where loose particles pre-classified by specific size need to be separated by density.

Having thus described a preferred embodiment, it should be apparent to those skilled in the art that certain advantages of the described method and apparatus have been achieved. In particular, those skilled in the art would appreciate that the proposed system and method provide for efficient by density-based separation of particles of loose granular substrates.

It should also be appreciated that various modifications, adaptations and alternative embodiments thereof may be made within the scope and spirit of the present invention. The invention is further defined by the following claims.

What is claimed is:

1. A pneumatic vacuum density-based particle separation system comprising:

a loading bin for receiving a loose substrate;

a separating feeder for feeding separated particles of the loose substrate, the separating feeder having a finned surface with slots positioned lengthwise for removal of the plate-shaped particles from the loose substrate;

a mesh conveyor belt;

an air compressor blowing air through the mesh conveyor belt;

transporting nozzles integrated with pyramidal-shaped separation bins and located over the mesh conveyor belt at different distances from the mesh conveyor belt;

discharge nozzles located under the mesh conveyor belt in the same plane as the transporting nozzles and under the transporting nozzles at different vertically adjustable distances from the mesh conveyor belt, wherein the discharge nozzles and the transporting nozzles are simultaneously adjusted for separation of the primary substrate mixture into particles of specific density;

a plurality of aspiration cyclones that connect the transporting nozzles to suction devices that generate pre-set velocity and lifting power of an air flow;

fans for generation of ascending laminar suction air flows in the transporting nozzles; and a discharge flow generator in each of the discharge nozzles;

wherein the transporting and discharge nozzles move along the mesh conveyor belt and the discharge nozzles are connected directly to the discharge flow generators.

2. The system of claim 1, wherein the feeder includes a frame and a tray with an adjustable angle of slope for feeding of the separated substrate by sliding, wherein the tray includes a set of plates and slots for filtering the plate-shaped particles.

3. The system of claim 2, wherein the frame and the tray are mounted on a vibratory suspension.

4. The system of claim 3 wherein the vibratory suspension includes an electric motor with a misbalanced shaft.

5. The system of claim 1, wherein the air compressor comprises a nozzle with a slot of the same width as the mesh conveyor belt.

* * * * *